US006777869B2

(12) United States Patent
Pavlovsky

(10) Patent No.: US 6,777,869 B2
(45) Date of Patent: Aug. 17, 2004

(54) TRANSPARENT EMISSIVE DISPLAY

(75) Inventor: Igor Pavlovsky, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 0 days.

(21) Appl. No.: 10/410,018

(22) Filed: Apr. 9, 2003

(65) Prior Publication Data

US 2003/0193288 A1 Oct. 16, 2003

Related U.S. Application Data

(60) Provisional application No. 60/371,356, filed on Apr. 10, 2002.

(51) Int. Cl.[7] ..... H01J 1/62

(52) U.S. Cl. ..... 313/496; 313/495

(58) Field of Search ..... 313/495–497, 313/309, 302, 303, 306, 307; 345/74.2, 75.2; 315/169.3

(56) References Cited

U.S. PATENT DOCUMENTS

| | | | | | |
|---|---|---|---|---|---|
| 4,568,928 | A | | 2/1986 | Biferno | 340/716 |
| 5,216,324 | A | * | 6/1993 | Curtin | 313/495 |
| 5,291,316 | A | | 3/1994 | Haberman et al. | 359/13 |
| 5,499,122 | A | | 3/1996 | Yano | 359/54 |
| 5,554,828 | A | * | 9/1996 | Primm | 178/19.06 |
| 5,646,479 | A | * | 7/1997 | Troxell | 313/495 |
| 5,706,022 | A | | 1/1998 | Hato | 345/92 |
| 5,757,127 | A | | 5/1998 | Inoguchi et al. | 313/507 |
| 5,801,477 | A | | 9/1998 | Macaulay | 313/309 |
| 5,808,711 | A | | 9/1998 | Suppelsa et al. | 349/74 |
| 5,900,301 | A | | 5/1999 | Brandes et al. | 428/77 |
| 5,907,382 | A | | 5/1999 | Kajiura et al. | 349/158 |
| 5,965,981 | A | | 10/1999 | Inoguchi et al. | 313/506 |
| 6,008,576 | A | * | 12/1999 | Nakatani et al. | 313/495 |
| 6,008,577 | A | | 12/1999 | Rasmussen et al. | 313/496 |
| 6,133,690 | A | * | 10/2000 | Meyer et al. | 313/495 |
| 6,146,230 | A | * | 11/2000 | Kim et al. | 445/51 |
| 6,171,663 | B1 | | 1/2001 | Hanada et al. | 423/1 |
| 6,235,398 | B1 | | 5/2001 | Nakamura et al. | 428/432 |
| 6,252,703 | B1 | | 6/2001 | Nakamura et al. | 359/360 |
| 6,298,592 | B1 | | 10/2001 | Baier | 40/611 |
| 6,327,089 | B1 | | 12/2001 | Hosaki et al. | 359/618 |
| 6,348,993 | B1 | | 2/2002 | Hori | 359/443 |
| 2003/0141495 | A1 | * | 7/2003 | Lee et al. | 257/10 |

FOREIGN PATENT DOCUMENTS

| | | | | |
|---|---|---|---|---|
| EP | 708431 | A2 * | 4/1996 | G09G/3/00 |
| EP | 0 798 590 | | 10/1997 | |
| EP | 1 079 413 | | 2/2001 | |
| EP | 1 081 718 | | 3/2001 | |
| EP | 1 103 885 | | 5/2001 | |
| EP | 1 104 000 | | 5/2001 | |
| EP | 1 107 025 | | 6/2001 | |
| EP | 1 113 308 | | 7/2001 | |
| EP | 0 869 473 | | 12/2001 | |
| WO | WO 99/41637 | | 8/1999 | |
| WO | WO 00/04411 | | 1/2000 | |
| WO | WO 01/04695 | | 1/2001 | |
| WO | WO 02/17287 | | 2/2002 | |

* cited by examiner

*Primary Examiner*—Vip Patel
*Assistant Examiner*—Glenn D. Zimmerman
(74) *Attorney, Agent, or Firm*—Kelly K. Kordzik; Winstead Sechrest & Minick P.C.

(57) ABSTRACT

A transparent emissive display is created using a transparent anode and a transparent cathode so that images can be viewed from both sides of the field emission display panel. When the phosphor material emits the image, it can pass through the field emission material, if such a material is effectively made transparent by the manner in which it is deposited. The cathode conducting layer and the cathode substrate are thus also made transparent. Alternatively, multiple displays can be stacked together.

2 Claims, 3 Drawing Sheets

TRANSPARENT EMISSIVE DISPLAY

CROSS REFERENCE TO RELATED APPLICATION

This Application claims priority to U.S. Provisional Patent Application Ser. No. 60/371,356, filed Apr. 10, 2002.

TECHNICAL FIELD

The present invention relates in general to displays, and in particular to field emission displays.

BACKGROUND INFORMATION

Transparent emissive displays are of special interest due to a variety of possible applications such as electronic windows, layer displays, stacked display panels, 3-D displays. Feasibility of making such a display has not been obvious since current display technologies use non-transparent materials such as silicon, thin film metal coatings, opaque dielectric layers, etc. Liquid crystal displays can be transparent, but they are not emissive and cannot target the applications mentioned above. An emissive display is a display in which the formation of an image involves mechanisms of light emission and which does not require an external light source. A non-emissive display is a display in which the formation of an image involves mechanisms of light reflection or absorption, and which requires an external light source.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
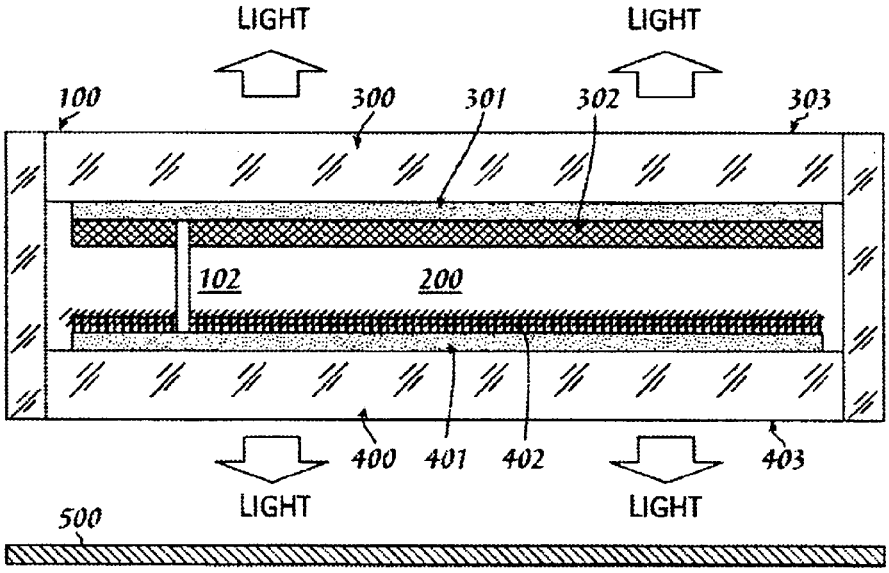
FIG. 1 illustrates an embodiment of the present invention.

In the following description, numerous specific details are set forth such as specific field emitters, etc. to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing consideration and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Referring to FIG. 1, one way of making a transparent emissive display is to design a field emission display such that it has a transparent anode 303, or screen, and transparent cathode 403, or electron emitting panel, both enclosed in a vacuum package 100, or constituting the parts of such a vacuum package, where a vacuum gap 200 exists between those anode 303 and cathode 403 panels. The display 100 is viewable from the side of the anode 303 or the cathode 403. A background screen 500 may be placed behind such a transparent display 100 to change viewability or transparency of, the display 100, which can be a black background, or another display, or still image, or any other background.

Figure 2:
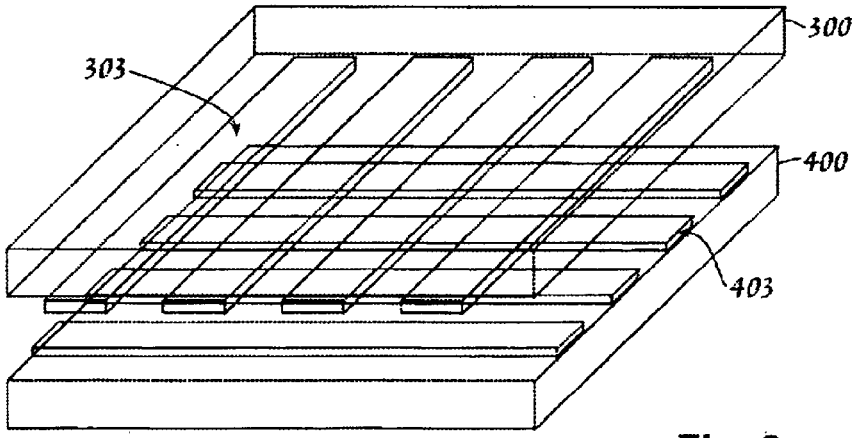
FIG. 2 illustrates another embodiment of the present invention.

The transparent anode 303 can be made of a glass, plastic, or other transparent substrate 300, covered with a transparent layer of phosphor 302. This can be an inorganic or organic thin film phosphor, or phosphor consisting of particles, like most of the phosphors used in cathode ray tubes and vacuum fluorescent displays, but having low density or treated such a way that it is transparent for visible light. The transparent conducting layer 301, such as indium tin oxide (ITO), is deposited between the phosphor 302 and the glass plate 300. The phosphor 302 and the conducting layer 301 can be patterned to provide addressability of different parts of the anode 303 to enable formation of an image. Such anode address lines 303 are shown in FIG. 2.

The transparent cathode 403 may comprise transparent plate 400 similar to the plate 300, and the transparent conducting layer 401 that covers the plate 400. A transparent field emission material 402 in the form of field emitting particles such as single-wall or multi-wall carbon nanotubes or similar emitters with size aspect ratios higher than 10, are attached to the layer 401, so that these particles are so rarely spaced and/or so small that they are effectively transparent to visible light. The emitter layer 402 and the conducting layer 401 can be patterned to provide addressability of different parts of the cathode 403 to enable formation of an image. Such cathode address lines 403 are shown in FIG. 2.

Applying a voltage (not shown) between the cathode 403 and the anode 303 will cause electrons to emit from the cathode 403, fly through the vacuum gap 200, and excite the phosphor 302. The vacuum in the vacuum gap 200 may be in the range of $10^{-3}$ to $10^{-10}$ torr, preferably in the range of $10^{-6}$ to $10^{-9}$ torr. The anode 303 and cathode 403 panels can be separated by spacers 102 to ensure the uniformity of the gap 200.

Figure 3A:
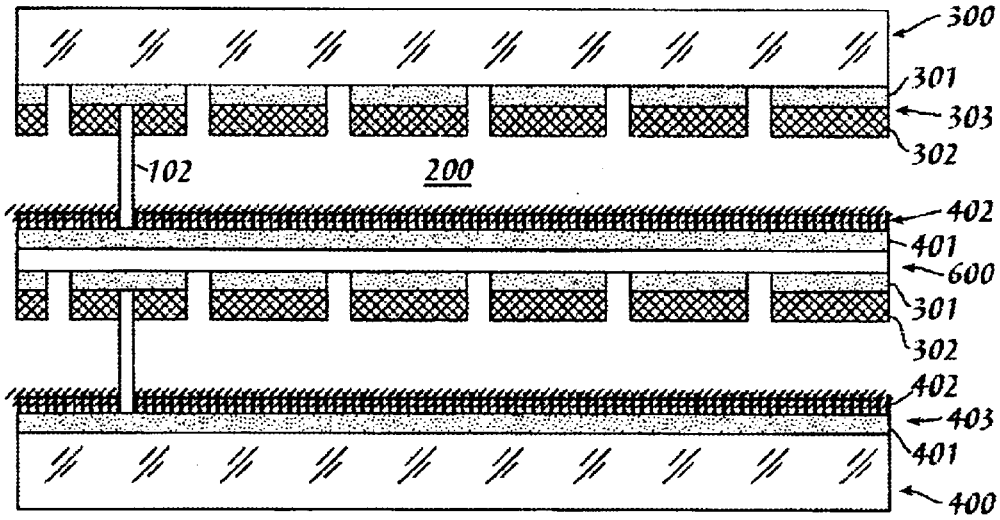
FIG. 3*a* illustrates another embodiment of the present invention.
Figure 3B:
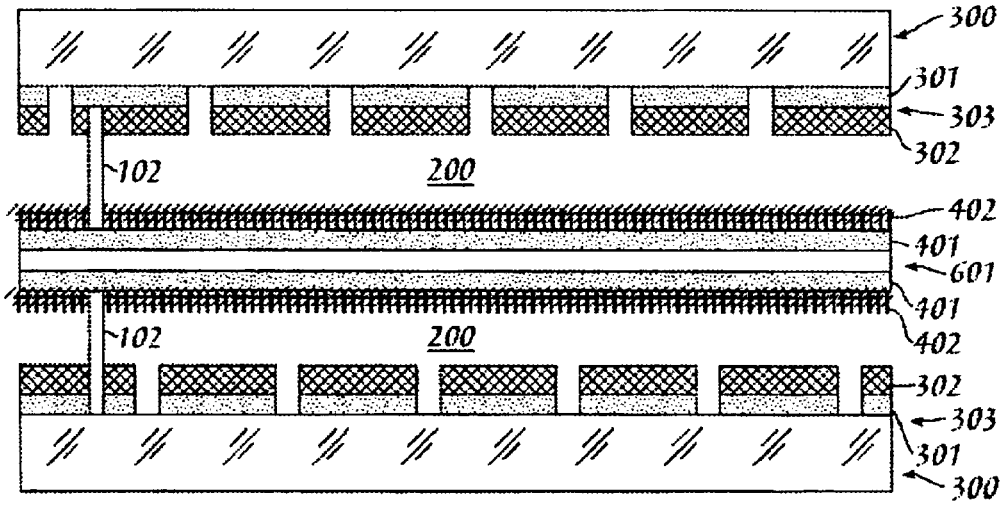
FIG. 3*b* illustrates another alternative embodiment of the present invention.

Referring to FIGS. 3*a* and 3*b*, the display panels may be stacked together to form a multi-layered (sandwiched) display. Such a display may consist of alternating plates, each of which may have similar types of electrodes on both plate sides—anode or cathode (see FIG. 3*b*), or different electrodes (FIG. 3*a*). Inside the vacuum package, the inner glass plates 600, 601 may be thin enough since there is no requirement to withstand the atmospheric pressure. This enables making a higher resolution display of this type. Spacers 102 can be used inside the transparent field emission display to make the gap 201 uniform over the display area.

Figure 4:
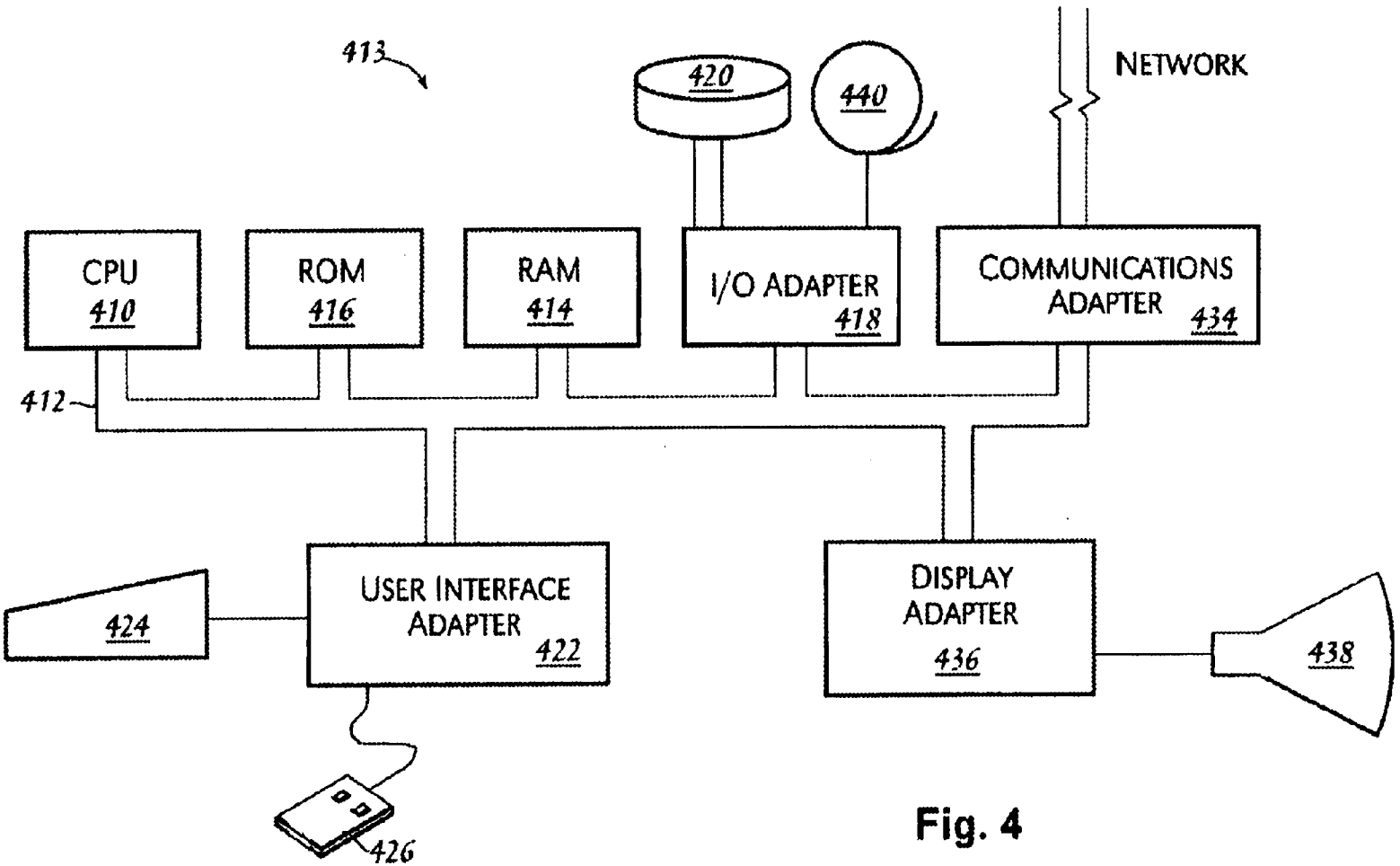
FIG. 4 illustrates a system configured in accordance with the present invention.

A representative hardware environment for practicing the present invention is depicted in FIG. 4, which illustrates an exemplary hardware configuration of data processing system 413 in accordance with the subject invention having central processing unit (CPU) 410, such as a conventional microprocessor, and a number of other units interconnected via system bus 412. Data processing system 413 includes random access memory (RAM) 414, read only memory (ROM) 416, and input/output (I/O) adapter 418 for connecting peripheral devices such as disk units 420 and tape drives 440 to bus 412, user interface adapter 422 for connecting keyboard 424, mouse 426, and/or other user interface devices such as a touch screen device (not shown) to bus 412, communication adapter 434 for connecting data processing system 413 to a data processing network, and display adapter 436 for connecting bus 412 to display device 438. CPU 410 may include other circuitry not shown herein, which will include circuitry commonly found within a microprocessor, e.g., execution unit, bus interface unit, arithmetic logic unit, etc. Display device 438 may comprise any one of the displays described herein.

Although the present invention and its advantages have been described in detail, it should be understood that various changes, substitutions and alterations can be made herein without departing from the spirit and scope of the invention as defined by the appended claims.

What is claimed is:

1. A field emission display comprising:

a first transparent anode further comprising:
- a first transparent substrate;
- a first transparent conductor layer deposited over the first transparent substrate; and
- a first phosphor deposited over the first transparent conductor layer;

a first transparent cathode further comprising:
- a second transparent substrate;
- a second transparent conductor layer deposited over the second transparent substrate; and
- a first effectively transparent field emitter deposited over the second transparent conductor layer;

a second transparent anode further comprising:
- a third transparent conductor layer deposited over the second transparent substrate; and
- a second phosphor deposited over the third transparent conductor layer;

a second transparent cathode further comprising:
- a third transparent substrate;
- a fourth transparent conductor layer deposited over the third transparent substrate; and
- a second effectively transparent field emitter deposited over the fourth transparent conductor layer.

2. A field emission display comprising:

a first transparent anode further comprising:
- a first transparent substrate;
- a first transparent conductor layer deposited over the first transparent substrate; and
- a first phosphor deposited over the first transparent conductor layer;

a first transparent cathode further comprising:
- a second transparent substrate;
- a second transparent conductor layer deposited over the second transparent substrate; and
- a first effectively transparent field emitter deposited over the second transparent conductor layer;

a second transparent anode further comprising:
- a third transparent substrate;
- a third transparent conductor layer deposited over the third transparent substrate; and
- a second phosphor deposited over the third transparent conductor layer;

a second transparent cathode further comprising:
- a fourth transparent conductor layer deposited over the second transparent substrate; and
- a second effectively transparent field emitter deposited over the fourth transparent conductor layer.

* * * * *